US005643424A

United States Patent [19]

Riffe et al.

[11] Patent Number: 5,643,424

[45] Date of Patent: *Jul. 1, 1997

[54] APPARATUS FOR THE PREVENTION OF FOULING AND/OR CORROSION OF STRUCTURES IN SEAWATER, BRACKISH WATER AND/OR FRESH WATER

[75] Inventors: William J. Riffe, Morehead City, N.C.; Jack D. Carter, Austin, Tex.

[73] Assignee: Marine Environmental Research, Inc., Morehead City, N.C.

[*] Notice: The term of this patent shall not extend beyond the expiration date of Pat. No. 5,009,757.

[21] Appl. No.: 267,379

[22] Filed: Jun. 29, 1994

Related U.S. Application Data

[60] Division of Ser. No. 658,582, Feb. 21, 1991, Pat. No. 5,346,598, which is a continuation-in-part of Ser. No. 523, 418, May 15, 1990, Pat. No. 5,055,165, which is a continuation-in-part of Ser. No. 145,275, Jan. 19, 1988, abandoned.

[51] Int. Cl.[6] ..... C23F 13/00

[52] U.S. Cl. ..... 204/196; 204/197; 205/705; 205/706; 205/724; 205/730; 205/731; 205/735; 205/740

[58] Field of Search ..... 204/147, 148, 204/196, 197; 205/705, 706, 724, 730–733, 735, 736, 740

[56] References Cited

U.S. PATENT DOCUMENTS

| | | | |
|---|---|---|---|
| 872,759 | 12/1907 | Schoneberger et al. | 204/197 |
| 1,269,926 | 6/1918 | Gesell | 204/197 |
| 3,497,434 | 2/1970 | Littauer | 204/196 |
| 3,620,943 | 11/1971 | White | 204/148 |
| 3,661,742 | 5/1972 | Osborn et al. | 204/147 |
| 4,196,064 | 4/1980 | Harms et al. | 204/196 |
| 4,502,936 | 3/1985 | Hayfield | 204/196 |
| 4,767,512 | 8/1988 | Cowatch et al. | 204/147 |
| 4,772,344 | 9/1988 | Andoe | 204/147 |
| 5,009,757 | 4/1991 | Riffe et al. | 204/147 |
| 5,055,165 | 10/1991 | Riffe et al. | 204/147 |
| 5,088,432 | 2/1992 | Usami et al. | 204/148 |

*Primary Examiner*—T. Tung

*Attorney, Agent, or Firm*—Oblon, Spivak, McClelland, Maier & Neustadt, P.C.

[57] ABSTRACT

A device and method for preventing fouling and/or corrosion of the exposed surfaces of a structure which is in contact with seawater, brackish water, fresh water, or a combination of these. The system includes using a structure having an exposed zinc-containing surface. At the exposed surface water interface a negative capacitive charge or an asymmetric alternating electrostatic is induced and maintained.

14 Claims, 3 Drawing Sheets

APPARATUS FOR THE PREVENTION OF FOULING AND/OR CORROSION OF STRUCTURES IN SEAWATER, BRACKISH WATER AND/OR FRESH WATER

This is a division of application Ser. No. 07/658,582, filed Feb. 21, 1991, now U.S. Pat. No. 5,346,598, which was a CIP of Ser. No. 07/523,418, filed May 15, 1990, now U.S. Pat. No. 5,055,165, which was a CIP of Ser. NO. 07/145,275, filed on Jan. 19, 1988, now abandoned.

FIELD OF THE INVENTION

The present invention relates generally to methods and apparatus for preventing fouling and/or corrosion of structures, and more particularly to methods and apparatus for preventing fouling and/or corrosion of marine vessels, buoys, piping systems, filters, oil rigs, and other structures fully or partially submerged in seawater, brackish water, fresh water, or a combination of these.

BACKGROUND OF THE INVENTION

Structures in contact with bodies of water suffer from fouling and/or corrosion damage. For example the shipping industry has long faced serious problems caused by the adherence of marine organisms to ship hulls. Such fouling of a ship's hull increases the operating cost of a ship and decreases its efficiency.

Marine organisms which become attached to the hull must periodically be removed, thereby usually taking the ship out of operation for extended periods of time for dry dock maintenance. Also, if fouling is not prevented, aquatic organisms will continue to attach to the hull and will cause ever increasing operating costs associated with additional fuel requirements and decreased speeds. The pleasure boat market faces similar problems.

Several ways of removing marine organisms, including barnacle growth, from a ship are known. Barnacles can be mechanically scraped from the ship while in dry dock. Cleaning machines have been developed having rotating brushes which can remove barnacles and other marine organisms from the hull.

Another method of overcoming the fouling problems has been to use highly toxic paints on the hulls of ships. Such paints retard the buildup of marine growth on the hull. A toxic element in the paint, such as a compound of copper or mercury which is soluble in seawater, is controllably dissolved into the water to provide protection over several years. However, the leaching of toxic materials into esturine waters by a vast number of vessels, including the pleasure boat population, presents an increasing hazard to the environment.

For example U.S. Pat. No. 3,817,759 discloses the use of an antifouling coating comprising a polymeric titanium ester of an aliphatic alcohol. Titanium has good corrosion resistance and low water solubility which prevents premature leaching and exhaustion of the coating.

Another known antifouling method involves coating the hull of a ship with a metallic paint whose ions are toxic to marine life, i.e., copper, mercury, silver, tin, arsenic, and cadmium, and then to periodically apply a voltage to the hull to anodically dissolve the toxic ions into seawater thereby inhibiting marine life growth. This method is disclosed in U.S. Pat. Nos. 3,661,742 and in 3,497,434.

Antifouling systems which rely on dissolution of toxic substances into seawater have limited utility since the coating applied to the hull is depleted and the hull must be periodically repainted. The problem is made more severe in those systems which make the hull anodic to force dissolution since it increases the rate of dissolution. This poses a potentially serious problem since once the hull is exposed it too will be dissolved, resulting in pitting or puncturing of the hull.

Various other apparatus have been purposed which rely upon application of a voltage to the hull of the ship or provision for flow of current through the hull of the ship to retard growth of marine organisms on the hull. Some systems have proposed the electrochemical decomposition of seawater causing gases to be produced near the submerged surfaces of the hull.

Proponents of such systems maintain that the gases prevent the adherence of marine organisms such as barnacles, algae, etc. Others suggest that high current can cause shock and retard the growth of marine organisms on the hull. None of these systems, however, have proven commercially successful for reasons of cost and poor antifouling results. Examples of these systems are disclosed in U.S. Pat. No. 4,196,064 and Russian Pat. No. 3388.

This problem is of course not limited to ships, but exists with all submerged structures capable of corroding.

Another aquatic animal, zebra mussels (*Dreissena polymorpha*), is posing major problems to electric utilities, and municipal and industrial facilities, that are dependent on raw waters, e.g., from the Great Lakes. The morphological, behavioral and physiological characteristics of zebra mussels promote rapid spread of the mussel within and between water bodies, colonization of natural and artificial structures, fouling of intakes, conduits, condensers, and piping systems, and resistant to on-line procedures typically used to maintain system reliability at fresh water power plants.

In the summer of 1989, the Electric Power Research Institute (EPRI) began to investigate the potential problems that can be caused by the zebra mussel and studied strategies for the utility industry to deal with these problems. The stimulus for this work was the rapid spread of the mussels, their impact on power plant operations, particularly those cited on Lake Erie, and concerns about current and future economic and ecological impacts.

Power plants offer prime habitats for zebra mussels. The plants contain a plethora of hard, relatively clean surfaces for mussels to colonize. This colonization is enhanced by the source and flow rate of water drawn into the plant. For example, most plants draw near-surface water where the larvae are found in the highest concentrations. In addition, flow rates specified at many intakes to prevent fish impingement are not high enough to prevent larval settlement. In fact, flowing water is advantageous for the settled mussels because it maintains food and dissolves oxygen concentrations necessary for sustenance. All power plant systems circulating raw water are vulnerable to zebra mussel fouling.

Large conduits, galleries and "boxes" can be subject to volume loss when mussels attach to the walls and each other forming mussel mats. These mats can reach thickness of several inches. Individual mussels can cause flow loss in small piping if flows are intermittent or slow enough for settlement or if mussels are transported to a construction. Even condensers are vulnerable to zebra mussel fouling. Only the very largest mussels have a shell height capable of blocking modern condenser tubing. However, mussel clusters, called druses, frequently break off from mussel mats. Such clusters have blocked up to 20% or more of the condenser tubes in a power plant on western Lake Erie.

To date, no satisfactory solution to this problem has been found. Large individual zebra mussels and mussel clusters can be removed by power plant traveling screens which serve to reduce their impact on cooling water systems. These screens are however not fine enough to remove early life stages (e.g., veliger larvae) which are capable of attachment in downstream locations inside power plants. The benefit of traveling screens is further reduced by large forebays that accommodate settlement and growth of mussel population. Physical filtration would require effective pore diameters on the order of 0.04 mm to retain the smallest larvae, and, as such, is impractical. By analogy to marine mussels, materials or coatings could theoretically be found that inhibit or prevent attachment of settling larvae. To date, none has yet been identified.

Another problem related to fouling of a ship's hull which the shipping industry has long attempted to solve is corrosion. Corrosion normally occurs to underwater portions of a ship's hull because the seawater acts as an electrolyte and current will consequently flow, as in a battery, between surface areas of differing electrical potential. The flow of current takes with it metal ions thereby gradually corroding anodic portions of the hull.

Various techniques have been developed to prevent corrosion. Sacrificial anodes of active metals such as zinc or magnesium have been fastened to the hull. Such anodes, through galvanic action, themselves corrode away instead of the hull.

Other systems use cathodic protection by impressed current. Such systems utilize long-life anodes which are attached to the hull to impress a current flow in the hull. The result is that the entire hull is made cathodic relative to the anode, thereby shielding it from corrosion. Such systems operate at very low-voltage levels, see, e.g., U.S. Pat. No. 3,497,434.

One known cathodic protection system utilizes a titanium anode plated with platinum. The platinum acts as the electrical discharge surface for the anode into the electrolytic seawater. No current is discharged from any surface portions of the electrode comprising titanium. This particular system impresses high current densities on the anode on the order of 550 amps per square foot. Since there is a high current flow from the platinum on other non-soluble anode metal, there is a very low potential and essentially no current flow from the surface of the titanium. An example of such a system is disclosed in U.S. Pat. No. 3,313,721.

A final problem faced by those desiring to develop a successful antifouling system is hydrogen embrittlement of the ship's hull. When electrolytic action takes place close to the surface of the ship's hull, such as in some of those systems described above, hydrolysis of the seawater may occur. Such hydrolysis releases hydrogen ions which cause embrittlement of the ship's hull. Consequently, it is important in any antifouling system which is installed that the system not be operated at such high current as to cause hydrolysis of the water thereby releasing hydrogen.

There is therefore a strongly felt need for a better method, and corresponding apparatus, for preventing the corrosion and/or fouling of structures which are fully or partially submerged in water.

SUMMARY OF THE INVENTION

Accordingly, it is an object of the present invention to provide a system, e.g., an electrochemical system, which prevents fouling in seawater or brackish water or fresh water ("water" hereinafter), of the exposed surfaces of metallic or nonmetallic, conductive structures exposed to the water.

Another object of the present invention is to provide an electrochemical system which applies a net negative potential to the exposed surfaces of such structures to avoid dissolution of a conductive zinc coating thereon thereby obviating the need for repainting the hull at periodic intervals.

Another object of the present invention is to provide an electrochemical system for preventing fouling and/or corroding, which eliminates the requirement of external anodes which are susceptible to damage.

Another object of the present invention is to provide an electrochemical system which utilizes low-current densities on the structure so as to avoid hydrogen embrittlement and reduce costs.

The present invention provides a method, and a corresponding apparatus, for preventing fouling and/or corrosion of the surface of a metallic or non-metallic structure (e.g., the hull of a ship, a buoy, a piping system, a filter, an oil rig, etc.) comprising a zinc-containing surface in contact with (e.g., partially or fully submerged) seawater, brackish water, or fresh water. Such fouling includes fouling with barnacles and other marine organisms. This result is achieved by impressing and maintaining a net negative electrostatic charge or, in a preferred embodiment, by inducing and maintaining an asymmetric alternating electrostatic potential on the surface and permitting only a small periodic current flow.

The surface(s) in contact with the water environment must comprise zinc. The structure may be made of zinc or of zinc alloy, or the surface(s) of the structure in contact with the water environment may be equipped with a zinc or zinc alloy layer forming an interface between the structure and the water, or the surface(s) of the structure in contact with the water may be equipped with a zinc-containing coating in conductive contact with the surface(s) in contact with the water. This zinc-containing surface of the structure has a resistance on the order of less than 1 ohm.

BRIEF DESCRIPTION OF THE FIGURES

A more complete appreciation of the invention and many of the attendant advantages thereof will be readily obtained as the same becomes better understood by reference to the following detailed description when considered in connection with the accompanying figures, wherein.

DETAILED DESCRIPTION OF THE INVENTION

Figure 1:
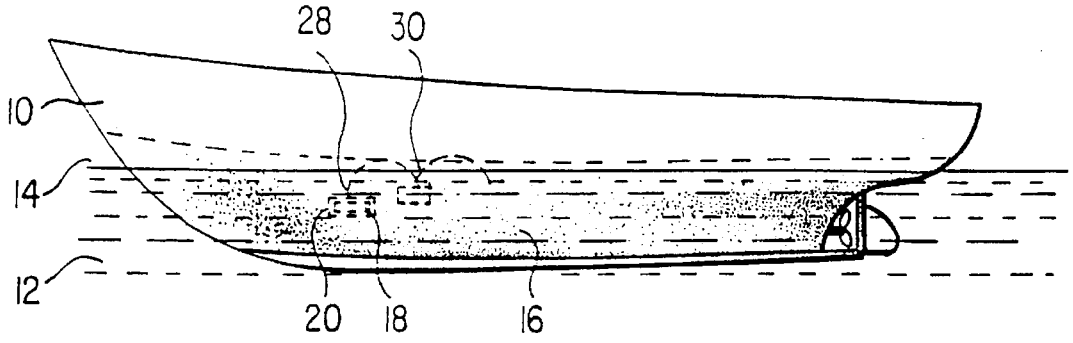
FIG. 1 is an illustration of a ship equipped with the antifouling device of the present invention.

The present invention relates to an antifouling and anticorrosion system which applies either a net negative electrostatic charge or a faradic potential on the surface(s) of the structure to protect the structure from fouling and/or corrosion. In a particular embodiment, the present invention prevents attachment of aquatic organisms such as barnacles, tubeworms and/or zebra mussels on the exposed surface(s) of aquatic structures, including the hulls of ships.

The structure which is protected in accordance with the present invention may be a ship, a pipe, a screen, a sheet, a bar, an expanded mesh, a perforated sheet, an expanded sheet, or a wire, or any other structure having any given form and which is exposed to a water environment. Such structures in contact with an aqueous environment, include buoys, piping systems, filters, oil riggs, and any other structure fully or partially submerged in sea water, brackish water, fresh water, or a combination of these, including power plant systems circulating raw water. The term "ship" used herein includes all and every known type of water crafts, including both submarines and surface vessels. In one preferred embodiment the present invention is advantageously applied to the hulls of ships.

In another preferred embodiment, the present invention is used to prevent attachment of zebra mussels to the exposed surfaces of structures susceptible to zebra mussel fouling. In this embodiment, the present invention provides a solution to zebra mussel fouling of any system dependent on raw waters, such as power plant equipment, including any and all power plant systems circulating raw water.

In one embodiment, a net negative capacitive charge is induced and maintained on the zinc-containing conductive surface(s) of the structure in contact with the water environment.

In one aspect of this embodiment, the net negative capacitive charge may be induced by using a means comprising a power supply having a terminal of a first polarity conductively connected to the surface(s) of the structure in contact with the water environment and a terminal of opposite polarity capacitively connected to the surface(s). The power supply and the capacitative connection means are both protected from contact by the water environment.

In another aspect of this embodiment the net negative capacitive charge may be in the form of a self-induced charge upon the surface(s) of the structure in contact with the water environment. With a self-induced charge, at least one bare metal surface which is galvanically exposed to the water medium is used, with the zinc-comprising surface being positive in relation to the bare metal surface. The bare metal surface(s) may be small blocks of copper, brass, iron, etc., attached to the external surface(s) of the structure. Any metal or metal alloy can be used for the bare metal surface(s) so long as the zinc-containing surface, when in the aqueous medium, is positive in relation to the bare metal surface.

In another embodiment, an induced periodic potential is used, providing an electrostatic charge on the zinc-containing surface providing an oscillating Helmholtz plane thereon. In this embodiment, the resulting asymmetric potentials and small periodic currents in the submerged conductive surface(s) prevent adherence of marine organisms to the surface(s) while simultaneously preventing corrosion of the submerged conductive structure more effectively than if a non-faradic negative electrostatic charge is applied.

Various plausible theoretical explanations of the results observed with the present invention are set forth in the text below. These explanations are provided to provide a thorough discussion of the present invention, but, being theories, must not be construed as limiting the invention.

The invention is also illustrated below with reference being made to the Figures. These Figures are illustrative of the invention and are not provided to limit the same in any way. For instance, the figures illustrate the application of the present invention to the hull of a ship equipped with a zinc-containing coating. And, the examples provided below illustrate the application of the present invention to buoys equipped with a zinc-containing coating forming an interfacial layer between the buoys' outer surface and the water.

As noted above however the present invention is not limited to ships or buoys, or to structures equipped with zinc-containing coatings, but can be applied to any structure made of zinc or of a zinc alloy, or to any structure having a surface(s) equipped with a layer of zinc or of a zinc alloy, as well as structures equipped with zinc-containing coatings. The minimum requirement is that the surface of the structure in contact with the aqueous environment contain zinc and that it be conductive.

In this vein, the structure itself, when it is not made of zinc or of a zinc alloy, can be made of any conductive or non-conductive material(s) suitable for the intended use of the structure. Thus the structure can be made of both metallic or non-metallic, e.g., polymeric or composite, material. Further, although the present invention can be used with metallic structures, various methods of rendering non-metallic structures conductive are currently available and utilization of the present invention with such structures is equally effective as when used with metallic structures, and thus within the scope of this invention.

As used in the present text, a zinc-containing surface is distinguished from a zinc-containing coating as follows. A zinc-containing surface is zinc-containing metallic layer applied to the surface of the structure. For example, such a surface could be a zinc-containing sheet or sheet attached onto (e.g., rivetted) the surface of the structure. A zinc-contaning coating is obtained by applying a zinc-containing composition, e.g., an inorganic zinc coating of the alkyl silicate or alkali hydrolyzed type, onto the surface structure. In accordance with the invention, galvanized is a coating.

In a preferred embodiment, the zinc-containing surface can be advantageously equipped with an additive or a mixture of additives which improve performance. Thus, the zinc-containing surfaces used in accordance with the present invention may further contain a silicate, i.e., $Na_2O:SiO_2$ of varying ratios, including sodium orthosilicate with a ratio of 2:1 and sodium metasilicate with a ratio of 1:1, and solid or liquid "water glasses" having ratios of 1:2 to 1:3.2 or ethyl silicate, to protect the zinc from dissolving into the aqueous media. This material may be present in the zinc-containing surface in an amount of up to 5 wt. %.

The zinc-containing surface may also advantageously contain iron oxide in an amount of up to 5 wt. % to passivate the zinc-containing surface and retard the release of zinc ions into the aqueous media. This prolongs the life of the zinc-containing surface.

The zinc-containing surface may also advantageously contain di-iron phosphide in an amount of up to 2 wt. %. This enhances the conductivity of the surface.

The zinc-containing surface(s) used in accordance with the present invention may contain a combination of two or more of a silicate, iron oxide and di-iron phosphide.

Use of a net negative capacitive charge:

This embodiment is an object of U.S. patent application Ser. No. 07/145,275, filed Jan. 19, 1988, which is hereby incorporated by reference.

In this embodiment, the present invention prevents corrosion and/or fouling of the conductive surface of a structure in contact with water by barnacles and/or other aquatic organisms, including zebra mussels, by impressing and maintaining a net negative electrostatic charge on the conductive surface of the structure (e.g., on the hull of a ship), which surface is rendered conductive and comprises zinc and is at least partially submerged in water, permitting only a small current flow. Because of the presence of charge on the zinc-containing surface, a Helmholtz double layer forms at the zinc/water interface. The innermost Helmholtz plane contains a high concentration of positively charged ions, most notably zinc and sodium. The outer Helmholtz plane consists of negatively charged ions, a relatively high concentration of which are hydroxyl ions. The negative hydroxyl ions in the outer Helmholtz plane are attracted to the positively charged zinc and sodium ions in the inner Helmholtz plane to form a caustic solution which destroys and/or repels the lower organisms of the fouling community. This prevents succession and attachment of higher organisms such as barnacles, tubeworms, and zebra mussels.

The antifouling system described herein has many advantages over prior systems, including the following. First, a negative potential is applied to the conductive surface rather than a positive potential so that there is only negligible dissolution of the surface. This eliminates the necessity for repainting and/or repairing the surface periodically. Second, while cathodic protection systems for preventing corrosion are known, they always employ external anodes. (See, e.g., the systems disclosed in U.S. Pat. Nos. 3,497,434 and 4,767,512.) The present invention incorporates an internal electrode which was not previously thought to be practical, and does not require an external anode (i.e., an anode in contact with the water). Third, prior devices using current to prevent fouling have typically involved high current densities so they cause hydrogen embrittlement of the hull and are expensive to operate. The present invention avoids these problems since it utilizes extremely low current densities with relatively high potential difference between the surface and the titanium electrode.

This preferred embodiment of the present invention is illustrated hereinbelow in terms of its application to a ship's hull. This application to a ship's hull is provided for purposes of illustrating the present invention without intending to limit the application of the present invention to any other structure which, in use, is in contact with (e.g., fully or partially submerged in) seawater, brackish water or fresh water. But as noted supra, the present invention is readily applied to marine vessels, buoys, oil rigs, and any other metallic or non-metallic structure which is fully or partially submerged in seawater, brackish water, or fresh water, including piping systems, filter systems, cooling systems, desalination systems, etc.

FIG. 1 provides a view of the ship's hull (10) which is at least partially submerged in seawater, brackish water, and/or fresh water (12). The exposed surface of the ship's hull (10) below the water line (14) is susceptible to fouling and/or corrosion.

Fouling appears to occur as a succession. First, dissolved nutrients in the water aggregate by van der Waals forces upon the exposed surface. Bacteria in the aquatic environment are chemotypically attracted to the adsorbed nutrients and form a bacterial slime layer of discernible thickness. The bacterial slime layer is then infiltrated by diatoms, algae, and other single celled organisms. Sessile organisms, such as barnacles, tubeworms and zebra mussels, feed upon the diatoms, algae, etc., and attach permanently to the nutrient-rich surface. These last animals and plants, which are large in volume, are commonly thought of as the "fouling" on ship's hulls, buoys, and other submerged structures.

The present invention appears to prevent fouling by breaking the chain from dissolved nutrients to higher plants and animals. The exposed surface of the ship's hull (10) is coated with a conductive zinc-containing coating (16) upon which is impressed a small negative current. A Helmholtz double layer forms at the surface/water interface which would appear to preclude the lower organisms of the fouling community from adhering to the exposed surfaces.

In a particularly preferred aspect of this embodiment, the ship's hull (10) is first sandblasted to white steel to remove oxides and produce a reactive surface. While in a reactive state, a conductive zinc rich paint, which may be a zinc rich inorganic paint, is applied to the steel hull (10) to form a predominantly zinc coating (16), which may be from 2.8 mils to 4.1 mils thick. Inorganic zinc coatings suitable for use with the present invention are of the alkyl silicate or the alkali hydrolyzed type which are commercially readily available. One such commercially available paint is Carbozinc 118 manufactured by Carboline, Inc., 1401 South Hanley Road, St. Louis, Mo. (U.S.A.) 63144.

For zinc-containing coatings, dry film coat having a zinc content of 82 to 97 weight percent is preferred, but zinc contents outside of this range, i.e., 70 to 99 weight percent, are also useful as long as a conductive zinc coating is obtained. Alternatively, a galvanized zinc coating can be used. The zinc coating (16) forms an interfacial layer between the water (12) and the ship's hull (10) and is bonded to the iron in the ship's hull (10).

Figure 2:
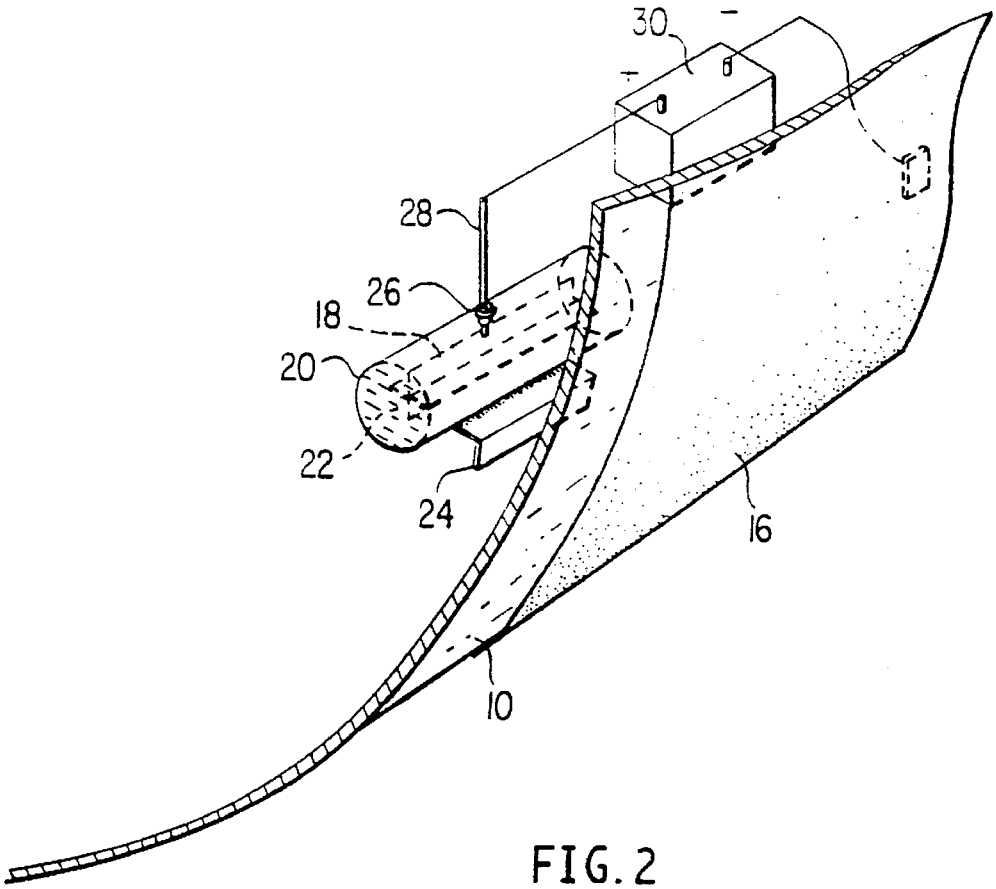
FIG. 2 is a perspective view of the condenser bank used in the invention.
Figure 5:
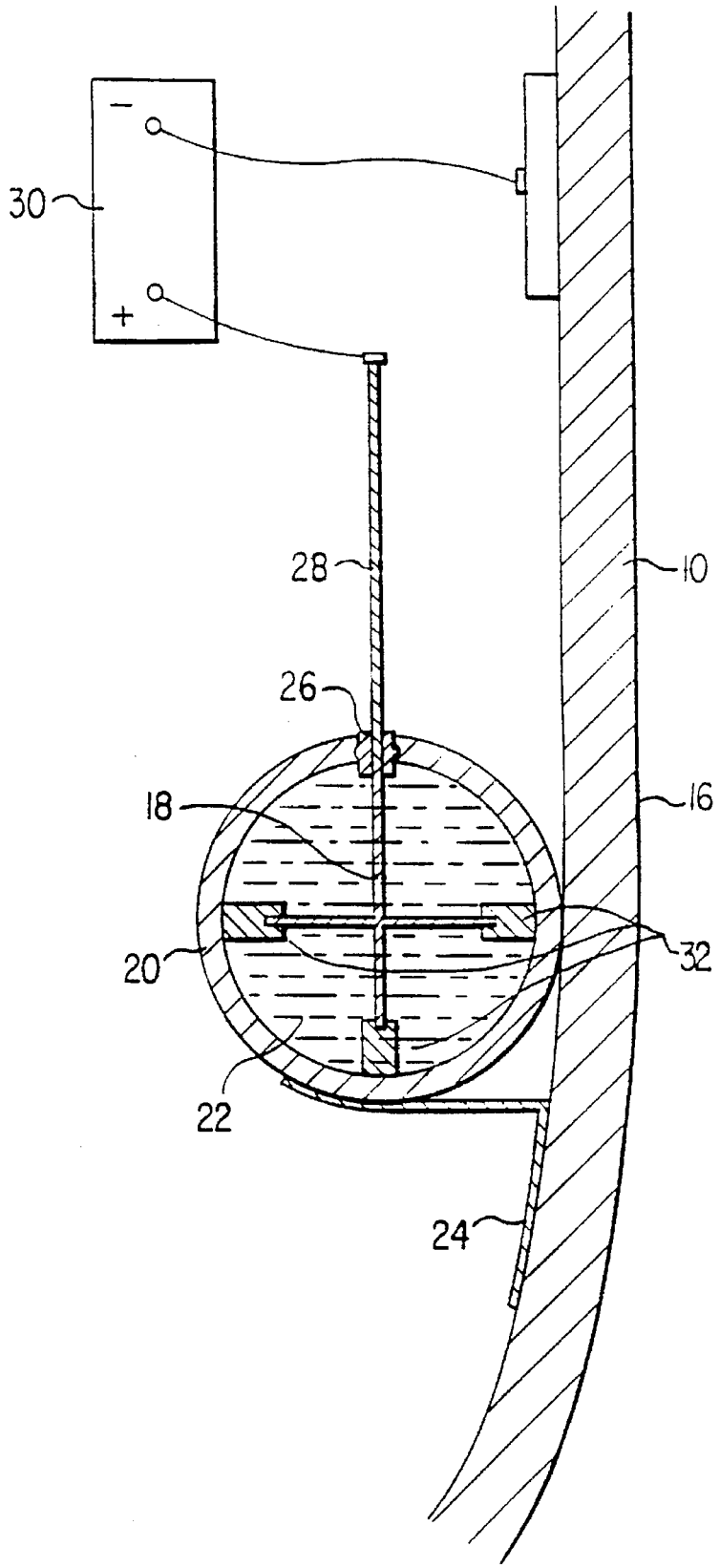
FIG. 5 is a section view of the titanium electrode.

In a preferred embodiment of the invention, one or more titanium electrodes (18) are disposed within the ship's hull (10), and capacitatively coupled to form a large electrolytic capacitor in which the ship's hull (10) functions as a negative plate. In the invention it is important that these titanium electrodes be protected from contact by the water (12). As seen in FIGS. 2 and 5, the titanium electrodes (18) are mounted on insulators (32) within a conductive hollow body (20) filled with a liquid electrolyte (22). The electrolyte may be, e.g., a mixture of ethylene glycol and water containing $Na_3PO_4$ borax, and sodium mercaptobenzothiazole. For example, the electrolyte may contain 1 to 10 wt. %, preferably 5 wt. % $H_2O$, 0.1 to 10 wt., preferably about 0.3 wt. %, $Na_3PO_4$, 2 to 10 wt. %, preferably about 4 wt. % borax, 0.1 to 1 wt. %, preferably 0.5 wt. %, mercaptobenzothiazole, the balance being ethylene glycol. The hollow body (20) is secured to the ship's hull (10) by a conductive mount (24).

An insulated through-hull fitting (26) penetrates the hollow body (20) and forms a water tight seal. The fitting (26) provides an insulated conduit through the hollow body (20). A titanium rod (28) of similar alloy as the titanium electrode (18) extends through the fitting (26) and is connected to the electrode (18).

A power supply means (30) is connected to the titanium rod (28) and the conductive surface of the ship's hull (10). In this embodiment, power supply means (30) preferably provides a potential difference of eight or more volts DC. The positive terminal of the power supply is connected to the titanium rod (28) externally of the hollow body (20) and the negative terminal is connected to the ship's hull (10). When the submerged surface area of the hull (10) is large, a plurality of contacts from the negative terminal of the power supply (30) to spaced apart points on the hull (10) may be required to assure a proper potential gradient across the entire surface.

Upon imposition of a positive charge, a titanium oxide film forms on the surface of titanium electrode (18), which film is only several angstroms thick and in intimate contact with the titanium electrodes (18). This oxide film can have a dielectric constant of up to 100.

It is known that aluminum and magnesium also will form an oxide film in a manner similar to titanium. However, such oxide films are much thinner and consequently, fail to operate as effectively to limit current. If a titanium electrode (18) is used, liquid electrolytes containing small ions such as bromides, chlorides, and fluorides should be avoided since they may pierce the oxide film.

As embodied herein, the entire system acts as a large electrolytic capacitor. The titanium electrode (18) functions as the positive plate with an impressed positive charge. The ship's hull (10) and the electrolyte (22) act as the negative plate with an impressed negative charge. The electrolyte (22) effectively moves the ship's hull (10) into close proximity to the titanium oxide dielectric creating a capacitative relationship between the electrode (28) and the ship's hull (10).

The oxide film which is formed on the titanium electrode (18), functions as the dielectric of the capacitor. Because of the dielectric effect of the oxide film, a relatively high potential difference can be applied between the ship's hull (10) and the titanium electrode (18) while permitting only a small controllable current leakage.

In this system the potential difference between the titanium electrode and the ship's hull (10) is approximately 8 to 10 volts. A half-cell voltage of approximately 0.9 to 1.2 negative volts DC measured from the ship's hull (10) to a silver-silver chloride reference cell is achieved. Current densities in the range of 4 to 8 mA $ft^{-2}$ are preferred. At these levels, there is sufficient energy to ionize water without evolving sufficient free hydrogen at the zinc/water interface to cause hydrogen embrittlement of the hull.

Figure 3:
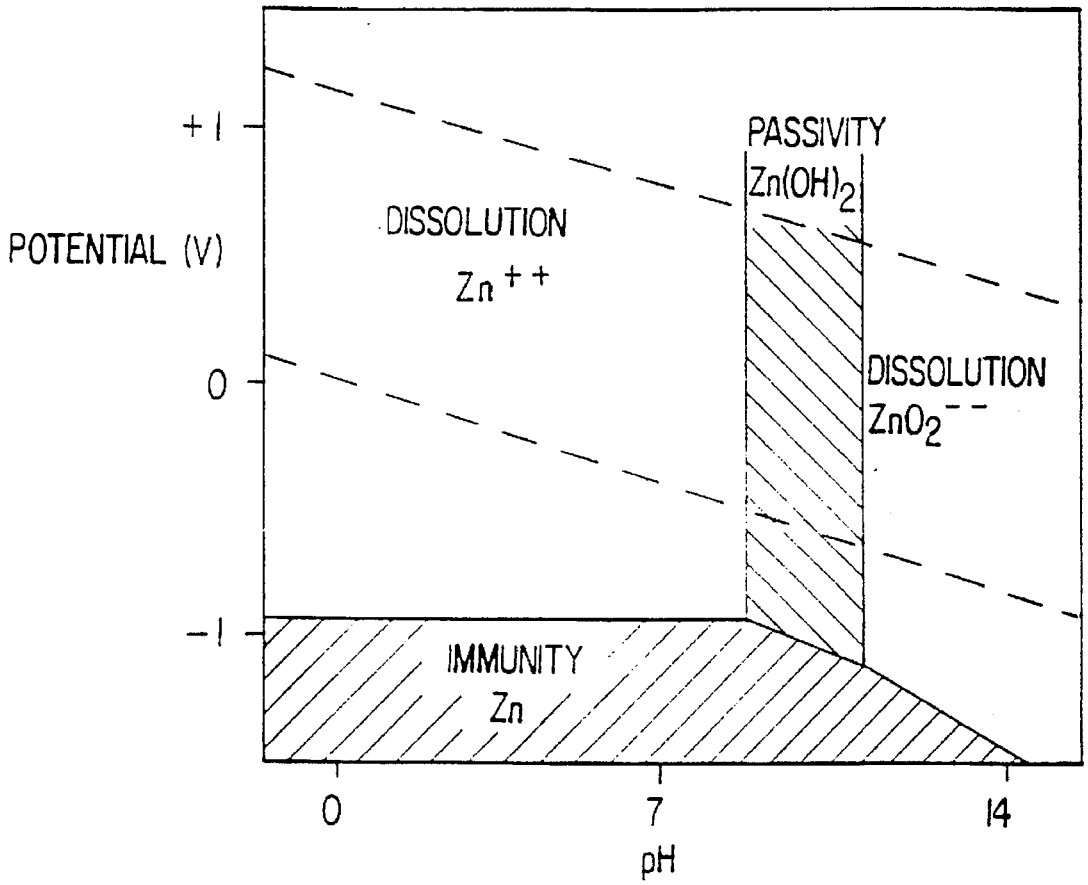
FIG. 3 is a Pourbaix diagram for zinc.

The negative charge impressed upon the ship's hull (10) and the conductively coupled zinc coating (16) causes limited electrolytic disassociation of water into hydrogen ions and hydroxyl ions. The hydroxyl ions combine with zinc ions oxided from the zinc coating (16) but are prevented from escaping by the pH level and the impressed charge. The resultant, zinc hydroxide, raises the pH level of the water from 7 to somewhere between 8 and 11 which is in the passivity range of zinc as shown in the Pourbaix diagram of FIG. 3. This effectively prevents dissolution of the zinc coating (16) into the water.

Figure 4:
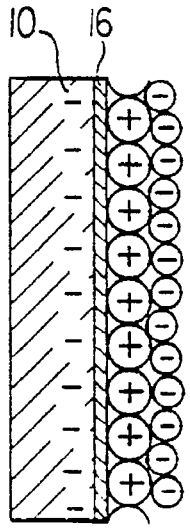
FIG. 4 is a schematic diagram showing the Helmholtz double layer which develops at the interface between the ship's hull and the water.

At the zinc/water interface there is developed a Helmholtz double layer, illustrated in FIG. 4. Within the innermost Helmholtz plane is a concentration of positively charged metallic ions disassociated from the adjacent water, i.e., calcium, magnesium, sodium, and zinc. Within the outermost Helmholtz plane, there is a concentration of negatively charged ions which are also disassociated from the water including hydroxyls in chloride. The hydroxyl ions in the outermost Helmholtz plane are chemically attracted to the zinc and sodium ions in the innermost Helmholtz plane and appear to form a caustic solution that prevents adherence of fouling organisms.

The present invention appears to prevent the development of the bacterial slime in two ways; one chemically oriented and one tropism oriented. It has been demonstrated that most bacterial cells possess a negative surface charge which, when placed in an electrical field, causes them to migrate away from the negative end. In the system embodied herein, the negative surface charge of the outer Helmholtz plane repels not only bacteria but many higher organisms in the food chain. Such organisms are not harmed by the negative charge, but are simply repelled and avoid the area in which they sense the effects.

The chemical effect upon fouling organisms has three major facets: saponaceous, osmotic, and poisonous. In the first case, the surface of the zinc is maintained at a pH level approaching 11. At this level of hydroxyl concentration, the lipid content of the bacterial cell reacts with sodium hydroxide, thus, destroying the bacterial capsule and killing the bacteria and other similar one-celled organisms. Secondly, there is a concentration of positive ions tightly bound to the zinc coating (16) as a result of the negative attraction of the coating (16). This results in higher concentrations of metallic ion salts. When a microorganism enters the inner Helmholtz plane, the salts have a negative osmotic effect and withdraw cellular fluid, thus, "salting out" the cell proteins and causing death of the organism. While some organisms in seawater can tolerate high osmotic pressures, they are not usually in the fouling community. Lastly, as salts of a heavy metal, zinc salts are capable of combining with and poisoning cellular protein. The toxic effect of zinc, however, is somewhat speculative since zinc has never been proven to be toxic as a coating in seawater.

Use of a self-induced charge:

In this embodiment of the invention at least one bare metal surface(s) which is galvanically exposed to the surrounding aqueous medium, with the zinc-containing surface (s) exposed to the water being positive to the bare metal surface(s), is used. This embodiment of the invention is to be distinguished from a possible accidental scratch through a zinc-containing coating painted onto a metal structure which would result in a self-induced charge upon the zinc interface because the zinc surface happens to be positive in relation to the bare metal surface galvanically exposed to the surrounding aqueous medium as a result of the scratch. Although such a geometry will provide the result of the present invention, to the inventors' knowledge no such observation and realization of the protective effect obtained thereby has been made.

With the invention, the bare metal surface(s) are situated on the surface of the structure exposed to the water environment. The bare metal surface may be made of a single metal or of an alloy of metals, with the only requirements being that the zinc-containing surface be positive in relation to the bare metal surface. For example, the bare metal surface(s) may be made of copper, brass, iron, etc. The bare metal surface may be in the form of a noble metal cathode situated externally to the structure with a capacitor couple being placed between the noble metal cathode and the zinc-containing surface, thereby providing a galvanic system providing the advantageous effects of the present invention. In general however, in this embodiment of the invention the bare metal surface made of a metal more noble than zinc is deliberately exposed and galvanically coupled to the zinc-containing surface. To distinguish it from a scratch which has a complex geometry, the bare metal surface used in accordance with the invention has a single geometry. The bare metal surface may be in the form of small blocks or strips of metal which are susceptible to easy replacement.

Use of a faradic potential:

The antifouling system described in this embodiment, which is quite similar to the above-described system and primarily distinguished therefrom by its use of an asymmetric alternating electrostatic potential instead of simply using a net negative capacitive charge, also has many advantages over currently available devices, including the following. First, the faradic potential applied to the conductive structure is skewed sufficiently negative so that there is negligible dissolution of the zinc-containing surface. This eliminates the necessity for periodically repainting and/or repairing surface structure. Second, while cathodic protection system for preventing corrosion are known, they always employ external anodes in contact with the water. The present invention incorporates an induced electrostatic charge which was not previously thought to be practical, advantageously not requiring external anodes (i.e., anodes in contact with the water). Third, currently available devices using current to prevent fouling of ship hulls have typically involved high current densities which cause hydrogen embrittlement of the hull and are expensive to operate. The present invention avoids these problems since it utilizes extremely low current densities with relatively high potential differences between the conductive structure and the water.

In this embodiment, the antifouling system comprises (a) a structure which is capable of being in contact with water and is equipped with a conductive zinc-containing surface corresponding to the submersible portion of the structure, with the zinc-containing surface forming an interfacial layer between the water and the structure, and (b) means for inducing and maintaining an asymmetric alternating electrostatic potential on the zinc-containing surface, sufficient to prevent fouling and/or corrosion of the surface. In this embodiment, an oscillating Helmholtz double layer is created and maintained at the interface between the zinc-containing surface and the water.

The means for inducing the asymmetric alternating electrostatic potential on the zinc-containing surface may comprise:

(c1) a means for interposing a dielectric between a first and a second conductor means, wherein the first conductor means is a power source of asymmetric alternating current attached conductively to a condenser bank so arranged with alternately directed diodes that the supplied current is converted to an asymmetric alternating electrostatic potential, with the second conductor being the structure; and (c2) means for generating a potential difference between the first conductor means and the second conductor means, with the second conductor means being negative with respect to the first conductor means.

Advantageously, the first conductor means is mounted internally, within the structure where it is protected from contact by the water. The system may also further include a faradic inductor system to convert an equipotential galvanic current source to an asymmetric alternating electrostatic potential mounted within the structure.

The first conductor means may be a power source of asymmetric alternating current attached conductively to a condenser bank so arranged, with alternately directed diodes, that the supplied current is converted to an asymmetric alternating electrostatic potential. The means for impressing the net negative electrostatic charge may include means for maintaining a current density on the structure sufficient to cause limited dissociation of the water and form zinc hydroxide, sodium hydroxide, and hydrogen peroxide at the oscillating Helmholtz double layer, without evolution of free hydrogen.

The antifouling system may be used on a structure which is at least partially submerged in water, with the zinc-containing surface being forming an interfacial layer between the water and the structure.

The means for impressing the asymmetric electrostatic potentials comprises a faradic, electrostatic conductor mounted internally within the water structure and means for creating an electrostatic potential between the water and the structure, while having a net negative charge with respect to the water. The means for impressing the net negative electrostatic charge can further comprise a means for maintaining a current density sufficient to dissociate water into its basic components and form zinc hydroxide, sodium hydroxide, and hydrogen peroxide at the Helmholtz double layer without evolution of free hydrogen.

The means for impressing the net negative electrostatic charge can further comprise an inductor apparatus for generating an asymmetric alternating electrostatic potential, with the apparatus being insulatively mounted within the structure to which it is conductively coupled. The conversion from galvanic to faradic potentials may be achieved by diode switching of current to condenser banks.

A power supply generator producing an asymmetric alternating polarity galvanic current may be used, connected conductively to a diode, condenser couple such that the galvanic current is converted to faradic electrostatic potential.

As with the embodiment discussed supra, FIG. 1 provides a view of a ship's hull (10) on which the antifouling coating of the present invention is at least partially submerged in water (12). The exposed surface of the ship's hull (10) below the water line (14) is susceptible to fouling by various marine organisms, including bacteria (which form a bacterial slime layer of discernible thickness), diatoms, algae, or other single-celled organisms, and more sessile organisms, such as barnacles, tubeworms, and zebra mussels.

In this embodiment, the exposed surface of the ship's hull (10) is also coated with a conductive zinc-containing coating (16) upon which is induced a faradically oscillating Helmholtz double layer at the surface/seawater interface which precludes the lower organisms of the fouling community from adhering to the exposed surface.

In one preferred embodiment here also the ship's hull (10) is first sandblasted to white metal to remove oxides and produce a reactive surface. While in a reactive state, a surface coating, termed inorganic zinc-rich paint, comprised of zinc powder or zinc oxide, and a "vehicle", e.g., a silicate-based "vehicle", which may be from 2.8 mils to 4.1 mils thick is applied by spray or brush. The resultant dry film coating, which is chemically covalently bonded to the metallic hull (10), can contain from 70 to 99, preferably 85 to 97, percent by weight zinc. Inorganic zinc coatings suitable for practicing the present invention are the alkyl silicate or the alkaline hydrolyzed type which are commercially available. One such available paint is Carbozinc 11® manufactured by Carboline, Inc.

In this embodiment of the invention, one or more power supply means (30) and condenser bank means (18) are disposed within the ship's hull (10). It is one important aspect of the invention that the one or more condenser bank means (18) are disposed in a manner preventing contact with the water (12). The one or more power supply means (30) and condenser bank means (18) are attached to the hull in such a manner that the hull (10) becomes a faradic conductor for the induced charges of the condenser banks.

The power supply mean (30) is connected between the condenser banks and the ship's hull providing an asymmetric alternating potential to each at a potential of from 1.0 to 10.0 volts. A half-cell voltage of approximately 0.9 to 1.2 negative volts DC measured from the ship's hull (10) to a silver-silver chloride reference cell in the water is achieved. Current densities of no more than 4 to 8 mA $ft^{-2}$ are preferred. At these levels, there is sufficient energy to protect the hull. When the submerged surface area of the hull (10) is large, a plurality of contacts from the negative terminal of power supply (30) to spaced apart-points on the hull (10) may be advantageously used to assure a proper potential gradient for the full length of the hull.

As embodied herein the entire system appears to act as a large Faradic Cage with the hull as the external screen from which induced charges may go to ground. In use, this effectively prevents dissolution of the zinc coating (16) into the seawater.

Although various theories have been advanced supra, whatever the antifouling mechanism, it is apparent that a conductive zinc coated surface submerged in water is resistant to fouling when impressed with a net negative potential contrary to prior teachings. Zinc alone has no antifouling affect. This was demonstrated in experiments where a test structure was coated with a zinc rich-paint and submerged in seawater. The test structure, without any negative charge impressed, fouled heavily.

Having generally described this invention, a further understanding can be obtained by reference to certain specific examples which are provided herein for purposes of illustration only and are not intended to be limiting unless otherwise specified.

EXAMPLES

Example 1

A buoy was constructed from a section of black, rolled steel covered with zinc-rich paint. A titanium electrode similar to that shown in FIGS. 2 and 5 was housed within. An eight-volt potential difference between the titanium electrode and the external pipe was impressed upon the assembly which was placed in the water in Bogue Sound at Morehead City. Extensive fouling was noted on cables used to secure the buoys; however, no appreciable fouling was found on the zinc-coated surfaces.

Example 2

A control buoy was installed, which, although zinc coated, had no titanium electrode and no impressed potential. The control buoy was placed in the water at the same location as the assembly described in Example 1 and was left for the same period of time. The control buoy was extensively fouled when placed in the water at the same period of time. The control buoy was extensively fouled when placed in the water at the same period of time. The control buoy was extensively fouled proving that inorganic zinc-rich paint itself is not an antifoulant.

Example 3

In this experiment a test buoy was constructed identical to that described in Example 1 except the buoy was not coated. The test buoy was placed in the water at the same location as the previous two assemblies and was left for the same period of time. Although a negative potential between the electrode and the surface of the buoy was impressed, the buoy was extensively fouled indicating that a charge on a metal surface alone will not prevent fouling.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system comprising:

(a) a structure having a conductive surface containing zinc suitable for being contacted by seawater, brackish water, fresh water, or a combination of these, wherein said structure is made of zinc or of a zinc-containing alloy, or said structure is made of a conductive or non-conductive material and is equipped with a conductive zinc-containing surface layer or a conductive zinc-containing coating applied to said structure, said zinc-containing surface layer or coating forming an interfacial layer between said structure and said water when said structure is contacted by said water, said coating further containing a silicate, iron oxide, di-iron phosphide, or a mixture thereof; and (b) means for (b1) inducing and maintaining a net negative capacitive charge on the surface of said structure or (b2) inducing and maintaining an asymmetric alternating electrostatic potential on the surface of said structure, sufficient to prevent corrosion or fouling of said structure, said means comprising at least one condenser bank attached to said structure, wherein, when said structure is contacted by said water, said at least one condenser bank is protected from contact by said water.

2. The system of claim 1, comprising said means for inducing and maintaining a negative capacitive charge.

3. The system of claim 1, comprising said means for inducing an asymmetric alternating electrostatic potential.

4. The system of claim 1, wherein said structure comprises a pipe, a screen, a bar, or a sheet.

5. The system of claim 4, wherein said structure comprises a ship's hull.

6. In a ship, the improvement comprising:

(a) a hull having a conductive zinc-containing surface wherein said hull is made of a zinc or a zinc-containing alloy, or said hull is made of a conductive or non-conductive material and is equipped with a conductive zinc-containing surface layer or a zinc-containing coating applied to said hull which is submerged when said ship is in water, said conductive zinc surface layer or coating forming an interfacial layer between said water and said conductive hull, said coating further containing a silicate, iron oxide, di-iron phosphide, or a mixture thereof; and (b) means for (b1) inducing and maintaining a negative capacitive charge on the surface of said hull or (b2) inducing and maintaining an asymmetric alternating electrostatic potential on the surface of said hull sufficient to prevent corrosion or fouling of said hull's surface, said means comprising at least one condenser bank attached to said hull, wherein, when said hull is at least partially submerged in said water, said at least one condenser bank is protected from contact by said water.

7. The ship of claim 6, comprising said means for inducing and maintaining a negative capacitive charge.

8. The ship of claim 6, comprising said means for inducing an asymmetric alternating electrostatic potential.

9. In a structure having a surface which is in contact with seawater, brackish water, fresh water, or a combination of these, the improvement comprising:

(a) said structure having a conductive zinc-containing surface, said structure being made of zinc or of a zinc-containing alloy, or said structure being made of a conductive or of a non-conductive material and having applied thereto a conductive zinc-containing surface layer or a zinc-containing coating, said conductive zinc-containing surface layer or coating forming an interfacial layer between said structure and said water, said coating further containing a silicate, iron oxide, di-iron phosphide, or a mixture thereof; and (b) said structure being equipped with means for (b1) inducing and maintaining a negative capacitive charge on said surface or for (b2) inducing and maintaining an asymmetric alternating electrostatic potential on said surface, sufficient to prevent corrosion or fouling of said structure, said means comprising at least one condenser bank attached to said structure and protected from contact by said water.

10. The structure of claim 9, comprising said means for inducing and maintaining a negative capacitive charge.

11. The structure of claim 10, comprising said means for inducing and maintaining an asymmetric alternating electrostatic potential.

12. A system for preventing fouling or corrosion of the exterior surface or surfaces of a structure capable of being in contact with a water environment, said structure having an interior surface and a conductive zinc-containing exterior surface, wherein said structure is made of zinc or of a zinc-containing alloy, or said structure is made of a conductive or non-conductive material and is equipped with a conductive zinc-containing surface layer or with a zinc-containing coating, wherein when said structure is in contact with said water environment, said zinc-containing surface layer or coating form an interfacial layer between said structure and said water environment, said coating containing a silicate, iron oxide, di-iron phosphide, or a mixture of these, said system comprising means for inducing and maintaining a negative capacitive charge on at least the part of said exterior surface in contact with said water environment sufficient to prevent fouling or corrosion of said exterior surface when said exterior surface is in contact with said water environment, said means comprising a power supply having a terminal of a first polarity conductively connected to said exterior surface and a terminal of opposite polarity capacitively connected to said exterior surface, said power supply and said capacitive connection means being both protected from contact by said water environment.

13. A system for preventing fouling or corrosion of an exterior surface or surfaces of a structure capable of being in contact with a water environment, said structure having an interior surface and a conductive zinc-containing exterior surface, wherein said structure is made of zinc or a zinc-containing alloy, or said structure is made of a conductive or non-conductive material and is equipped with a conductive zinc-containing surface layer or a zinc-containing coating, wherein when said structure is in contact with said water environment, said zinc-containing surface layer or coating form an interfacial layer between said structure and said water environment, said coating containing a silicate, iron oxide, di-iron phosphide, or a mixture of these, said system comprising means for inducing and maintaining a negative capacitive charge on at least the part of said exterior surface in contact with said water sufficient to prevent fouling or corrosion of said exterior surface when said exterior surface is in contact with said water environment, said means comprising a power supply having a terminal of a first polarity conductively connected to said exterior surface and a terminal of opposite polarity capacitively connected to said exterior surface, said power supply and said capacitive connection means being both situated in the interior of said marine structure.

14. The system of claim 13, wherein said structure is a ship, a pipe, a screen, a sheet, or a bar.

* * * * *